US008658028B2

(12) United States Patent
Uppal et al.

(10) Patent No.: US 8,658,028 B2
(45) Date of Patent: Feb. 25, 2014

(54) REMOVAL OF ELEMENTAL SULFUR IN PIPELINES USING STATIC MIXERS

(75) Inventors: Ashok Uppal, Sarnia (CA); Ramesh R. Hemrajani, Millington, NJ (US); Robert J. Falkiner, Mississauga (CA); Lawrence J. Lawlor, Camlachie (CA); Joseph L. Feimer, Brights Grove (CA)

(73) Assignee: ExxonMobil Research and Engineering Company, Annandale, NJ (US)

( * ) Notice: Subject to any disclaimer, the term of this patent is extended or adjusted under 35 U.S.C. 154(b) by 573 days.

(21) Appl. No.: 12/448,684

(22) PCT Filed: Jan. 17, 2008

(86) PCT No.: PCT/US2008/000603

§ 371 (c)(1),
(2), (4) Date: Jul. 30, 2009

(87) PCT Pub. No.: WO2008/091522

PCT Pub. Date: Jul. 31, 2008

(65) Prior Publication Data

US 2010/0072109 A1 Mar. 25, 2010

Related U.S. Application Data

(60) Provisional application No. 60/881,210, filed on Jan. 19, 2007.

(51) Int. Cl.
*C10G 19/02* (2006.01)

(52) U.S. Cl.
USPC ..... 208/229; 208/226; 208/230; 208/284; 208/286

(58) Field of Classification Search
USPC ..... 208/226, 229, 230, 284, 286
See application file for complete search history.

(56) References Cited

U.S. PATENT DOCUMENTS

| | | | |
|---|---|---|---|
| 2,460,227 | A | 1/1949 | Hart et al. |
| 4,011,882 | A | 3/1977 | Nivens et al. |
| 4,123,350 | A | 10/1978 | Baird, Jr. et al. |
| 5,080,695 | A | 1/1992 | Kassarjian |
| 5,160,045 | A | 11/1992 | Falkiner et al. |
| 5,199,978 | A | 4/1993 | Poirier et al. |
| 5,250,180 | A | 10/1993 | Chang |
| 5,250,181 | A | 10/1993 | Falkiner et al. |
| 5,618,408 | A | 4/1997 | Poirier et al. |
| 5,674,378 | A | 10/1997 | Kraemer et al. |
| 2004/0222134 | A1 | 11/2004 | de Souza |

OTHER PUBLICATIONS

"Sodium Sulfides", Kirk-Othmer Encyclopedia of Chemical Technology, published online Dec. 4, 2000, pp. 1-7.*

H.S. Gandhi and M. Shelef, "Effects of sulphur on noble metal automotive catalysts", Applied Catalysis, vol. 77 (1991) pp. 175-186.

Rene G. Gonzalez, "Can you Make Low-Sulfur Fuel and Remain Competitive?", Hart's Fuel Technology & Management, Nov./Dec. 1996.

W.A. Tasucher and F.A. Streiff, "Static Mixing of Gases", CEP Apr. 1979.

The International Search Report and Written Opinion of PCT/US08/00603 dated May 16, 2008.

* cited by examiner

*Primary Examiner* — Renee E Robinson

(74) *Attorney, Agent, or Firm* — David M. Weisberg; Bruce M. Bordelon

(57) ABSTRACT

A process for removing elemental sulfur from liquid hydrocarbon steams such as transportation fuel streams, e.g. gasoline, diesel, kerosene, and jet, by contacting such streams with an immiscible aqueous solution under static mixing conditions. The aqueous solution contains a caustic and an effective amount of a Group I or Group II metal sulfide or polysulfide. The elemental sulfur in the stream is converted to a polysulfide that is not soluble in the hydrocarbon stream but is soluble in the aqueous solution, thus resulting in a hydrocarbon product stream having a substantially lower level of elemental sulfur.

11 Claims, 3 Drawing Sheets

REMOVAL OF ELEMENTAL SULFUR IN PIPELINES USING STATIC MIXERS

CROSS REFERENCE TO RELATED APPLICATIONS

This Application claims the benefit of U.S. Provisional Application 60/881,210 filed Jan. 19, 2007.

FIELD OF THE INVENTION

The present invention relates to a process for removing elemental sulfur from liquid hydrocarbon steams such as transportation fuel streams, e.g. gasoline, diesel, kerosene, and jet, by contacting such streams with an immiscible aqueous solution under static mixing conditions. The aqueous solution contains a caustic and an effective amount of a Group I or Group II metal sulfide or polysulfide. The elemental sulfur in the stream is converted to a polysulfide that is not soluble in the hydrocarbon stream but is soluble in the aqueous solution, thus resulting in a hydrocarbon product stream having a substantially lower level of elemental sulfur.

BACKGROUND OF THE INVENTION

It is well known that elemental sulfur in hydrocarbon streams, such as petroleum streams, is corrosive and damaging to metal equipment, particularly copper and copper alloys. Elemental sulfur and sulfur compounds may be present in varying concentrations in refined petroleum streams. Additional contamination will typically take place as a consequence of transporting the refined stream through pipelines that contain sulfur contaminants remaining in the pipeline from the transportation of sour hydrocarbon streams, such as petroleum crudes. The sulfur also has a particularly corrosive effect on equipment, such as brass valves, gauges and in-tank fuel pump copper commutators.

Various techniques have been reported for removing elemental sulfur from petroleum streams. For example, U.S. Pat. No. 4,149,966 discloses a method for removing elemental sulfur from refined hydrocarbon fuels by adding an organo-mercaptan compound plus a copper compound capable of forming a soluble complex with the mercaptan and sulfur. The fuel is contacted with an adsorbent material to remove the resulting copper complex and substantially all the elemental sulfur.

U.S. Pat. No. 4,011,882 discloses a method for reducing sulfur contamination of refined hydrocarbon fluids transported in a pipeline for the transportation of sweet and sour hydrocarbon fluids by washing the pipeline with a solution containing a mixture of light and heavy amines, a corrosion inhibitor, a surfactant and an alkanol containing from 1 to 6 carbon atoms.

U.S. Pat. No. 5,618,408 teaches a method for reducing the amount of sulfur and other sulfur contaminants picked-up by refined hydrocarbon products, such as gasoline and distillate fuels, that are pipelined in a pipeline used to transport heavier sour hydrocarbon streams. The method involves controlling the level of dissolved oxygen in the refined hydrocarbon stream that is to be pipelined.

The removal of elemental sulfur from pipelined fuels is also addressed in U.S. Pat. No. 5,250,181 which teaches the use of an aqueous solution containing a caustic, an aliphatic mercaptan, and optionally a sulfide to produce an aqueous layer containing metal polysulfides and a clear fluid layer having a reduced elemental sulfur level. U.S. Pat. No. 5,199,978 teaches the use of an inorganic caustic material, an alkyl alcohol, and an organo mercaptan, or sulfide compound, capable of reacting with sulfur to form a fluid-insoluble polysulfide salt reaction product at ambient temperatures. It also teaches very long residence times of about 30 seconds to a few hours. The present invention only requires a residence time of a few seconds or less.

Also, U.S. Pat. No. 5,674,378 teaches a process for removing elemental sulfur from various hydrocarbon process streams by use of a treatment solution comprised of water or immiscible alcohol, caustic sulfide or hydrosulfide under dynamic mixing conditions.

While such methods have met with varying degrees of success, there still exists a need in the art for a method capable of reducing the amount of elemental sulfur in hydrocarbon streams, especially those that are transported through a pipeline.

SUMMARY OF THE INVENTION

In accordance with the present invention there is provided a process for the removal of elemental sulfur from a hydrocarbon stream containing same, which process comprises:

a) treating said hydrocarbon stream with an effective amount of an aqueous solution comprised of caustic and at least one sulfide compound selected from the group consisting of Group I and Group II metal sulfides and polysulfides;

b) conducting said treated hydrocarbon stream through one or more sections of pipe whose inner surface contains one or more mixing elements wherein said treated hydrocarbon stream is subjected to static mixing conditions for an effective amount of time thereby resulting in a two phase system wherein the aqueous solution is one phase and the hydrocarbon stream is another phase and wherein the elemental sulfur of the hydrocarbon stream is converted to polysulfides that are substantially insoluble in the hydrocarbon stream but substantially soluble in the aqueous phase and wherein at least a portion of the polysulfides formed from elemental sulfur of the hydrocarbon stream dissolves in the aqueous phase;

c) conducting the two phase system of b) above to a liquid/liquid separation zone wherein the two phase system is separated into a hydrocarbon phase and an aqueous phase containing dissolved polysulfides formed from the elemental sulfur of the hydrocarbon stream;

d) collecting the resulting hydrocarbon stream from said liquid/liquid separation zone, which hydrocarbon stream is substantially reduced in elemental sulfur; and e) collecting the aqueous phase containing polysulfides formed from elemental sulfur of the hydrocarbon stream.

In a preferred embodiment, the hydrocarbon stream is a petroleum stream selected from the group consisting of naphtha boiling range streams and distillate boiling range streams.

In another preferred embodiment the hydrocarbon stream to be treated contains from about 1 to about 1,000 mg of elemental sulfur per liter.

In yet another preferred embodiment, the caustic is selected from sodium hydroxide and potassium hydroxide.

In still another preferred embodiment, the Group I and Group II metal sulfide is selected from the group consisting of $Na_2S$, $K_2S$, $Li_2S$, NAHS, and $(NH^4)_2S$.

In another preferred embodiment the sulfide is a polysulfide represented by the formula $Na_2S_x$ where x=2 to 7.

DETAILED DESCRIPTION OF THE INVENTION

Figure 1:
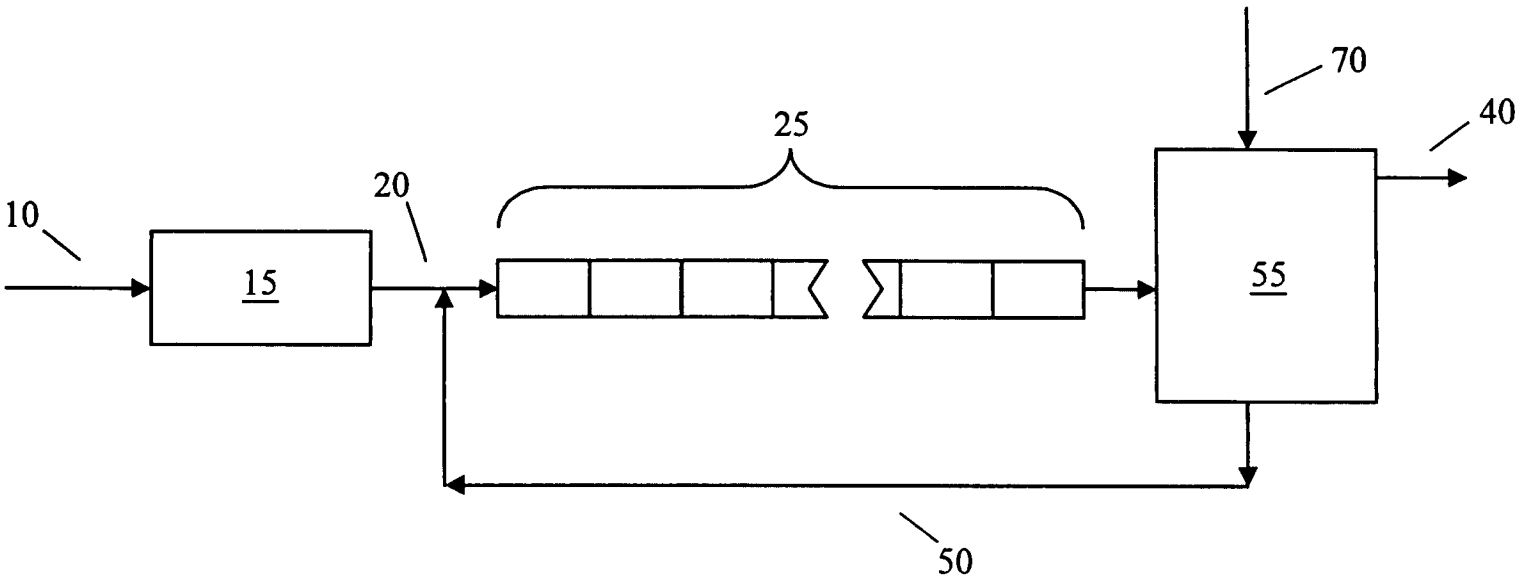
FIG. 1 hereof is a simplified flow scheme of one preferred embodiment for practicing the present invention.

Hydrocarbon streams containing quantities of elemental sulfur as high as 1000 mg/l can be effectively treated in accordance with this invention to reduce the sulfur contamination to less than about 10 mg/l, preferably less than about 5 mg/l, and more preferably to less than 1 mg/l. Preferred hydrocarbon streams include transportation fuels (e.g. gasoline, kerosene, diesel, jet), fuel blending components such as octane improvers (ethers such as MTBE), mixtures thereof, liquefied petroleum gas (LPG), solvents, and other petroleum and chemical streams that have been contaminated as a result of being transported in pipelines that are otherwise used for the transportation of sour hydrocarbon streams such as crude oil. The contamination can also result in other ways, such as in storage tanks and in distribution. Preferred ether streams that can be treated in accordance with the present invention are those comprised of alkyl ethers that are typically used to improve the octane number of gasoline. These ethers are typically dialkyl ethers having 1 to 7 carbon atoms in each alkyl group. Illustrative ethers are methyl tertiary-butyl ether, methyl tertiary-amyl ether, methyl tertiary-hexyl ether, ethyl tertiary-butyl ether, n-propyl tertiary-butyl ether, and isopropyl tertiary-amyl ether. Mixtures of these ethers and hydrocarbon streams may also be treated in accordance with this invention.

Preferred hydrocarbon streams that are treated in accordance with the present invention are refined hydrocarbon streams wherein elemental sulfur has been, or will be, picked-up when the stream is transported through a pipeline. By pipeline we mean the pipeline network that delivers petroleum products throughout a geographic region. Such preferred streams are also those wherein the elemental sulfur is detrimental to the performance of the intended use of the hydrocarbon stream. More preferred streams to be treated in accordance with the present invention are distillate boiling range streams. Non-limiting examples of hydrocarbon feed streams boiling in the distillate range include diesel fuels, jet fuels, and heating oils. Such streams typically have a boiling range from about 150° C. to about 400° C. Another type of hydrocarbon stream that is also preferred for being treated in accordance with the present invention are naphtha boiling range streams, which are also referred to as gasoline boiling range streams. Naphtha boiling range streams can comprise any one or more refinery streams boiling in the range from about 10° C. to about 250° C., at atmospheric pressure. The naphtha boiling range stream generally contains cracked naphtha that typically comprises fluid catalytic cracking unit naphtha (FCC catalytic naphtha, or cat cracked naphtha), coker naphtha, hydrocracker naphtha, resid hydrotreater naphtha, debutanized natural gasoline (DNG), and gasoline blending components from other sources from which naphtha boiling range stream can be produced.

The hydrocarbon stream to be treated will typically contain quantities of elemental sulfur from about 1 to about 1000 mg per liter, typically from about 1 to about 100 mg per liter, more typically from about 1 to 60 mg per liter, and most typically from about 1 to 30 mg per liter. Such streams can be effectively treated in accordance with the present invention to reduce the elemental sulfur contamination to less than about 10 mg per liter, preferably to less than about 5 mg per liter, and most preferably to less than about 1 mg per liter. Preferred hydrocarbon streams are those streams that have become contaminated with residual elemental sulfur as a result of being transported in a pipeline that was previously used to transport sour hydrocarbon streams, such as sour petroleum crudes. Also preferred are those streams that picked up residual sulfur as a result of being stored in a container or tank that has previously stored a sulfur-containing material. The caustic component that is used in the practice of this invention includes those of an alkali metal or ammonium hydroxides. The caustic will have the formula MOH wherein M is selected from the group consisting of lithium, sodium, potassium, $NH_4$, or mixtures thereof. M is preferably sodium or potassium, more preferably sodium.

As previously mentioned, the elemental sulfur containing liquid organic stream is treated, under static mixing conditions, with an aqueous solution that is immiscible in the liquid hydrocarbon stream. The aqueous solution will contain a caustic and an effective amount of Group I or Group II metal sulfide or polysulfide. Preferred Group I metals are Na, K, and Li with Na and K being more preferred and Na being most preferred. Preferred Group II metals are Ca and Mg. Examples of preferred monosulfides include $Na_2S$, $K_2S$, $Li_2S$, NAHS, $(NH_4)_2S$, and the like, with $Na_2S$ being the most preferred. Examples of preferred polysulfides are represented by the formula $Na_2S_x$ where x=2 to 7. Polysulfides are preferred over monosulfides. The sulfide in caustic reacts with the elemental sulfur of the hydrocarbon stream being treated to form polysulfides, which are captured in the aqueous solution where they are substantially soluble as opposed to the staying in the hydrocarbon stream where they are substantially insoluble. The caustic may be present in a convenient source of caustic such as white liquor from paper pulp mills. The concentration of the treating solution will be from about 5 to about 40 wt. % caustic, preferably from about 10 to about 40 wt. % caustic and more preferably from about 15 wt % to about 30 wt. % caustic; from about 0.1 to about 5 wt. %, preferably from about 0.5 wt % to about 5 wt. %, and more preferably from about 1 wt. % to about 3 wt. % Group I sulfide, polysulfide or mixture thereof.

The present invention is practiced by contacting, in a static mixing zone, the sulfur containing hydrocarbon stream with the immiscible aqueous solution to form a mixture wherein the aqueous solution constitutes one liquid phase, preferably the continuous phase of the mixture. The treated hydrocarbon fluid is the other phase and is preferably the discontinuous phase. If the aqueous solution phase were the dispersed phase, the percentage of elemental sulfur removal will be significantly less than when the aqueous solution phase is the continuous phase for the same volume percent of caustic hold up and reaction time. Typical static mixers include fluid redirecting tabs, vanes, baffles, or the like, that are arranged in a fluid conduit and that are typically operable to divide, subdivide, separate adjacent subdivided flows, and then recombine the subdivided flows into a "shuffled" whole, as the fluid passes through that conduit. Non-limiting examples of static mixers are those described and sold by the SULZER Company and, for example, those known under reference SMV or SMX, described in particular in the journal Chemical Engineering Progress, Vol. 75, No. 4, April 1979, pages 61 to 65. Another type of static mixer is also described in patent EP-B212 202. Descriptions of a static mixer that can be used within the scope of this invention will also be found in the book entitled "Les reacteurs chimiques, conception, calcul et mise en oeuvre>Chemical Reactors, Design, Calculation, and Use" published by TECHNIP Editions in 1984, in particular pages 599 to 605. All the above are incorporated herein by reference.

The advantage of the static mixers of the present invention over dynamic mixers, other than the fact that static mixers have no moving parts, is that static mixers split the stream hundreds, or even thousands of times, thus resulting in a continuous phase containing very fine droplets of discontinuous phase. This results in a much larger surface area when compared with dynamic mixers. Another advantage of static mixers over dynamic mixers is that they can provide substantially high mixing energies while maintaining a relatively narrow distribution of droplet size which is more desirable than a wider distribution of droplet size, which happens during dynamic mixing.

The time in which the elemental sulfur-containing stream is subjected to static mixing conditions will be an effective amount of time. That is, that amount of time needed to convert a predetermined amount, preferably substantially all, of the elemental sulfur into the corresponding polysulfide. Since the resulting polysulfides are substantially insoluble in the hydrocarbon fluid being treated, but are at least partially soluble in the aqueous solution they will migrate to the aqueous solution. The treated organic fluid will consequently have a substantially lower level of elemental sulfur. For a diesel stream, this amount of time will range from about 0.5 to about 30 seconds. The total length of static mixer sections can depend on the flow rate of the stream to be treated. An increase in flow rate will typically mean an increase in mixing energy but a decrease in residence time. For example, a larger number of static mixers may be needed with increasing flow rates. Although the entire length of the conduit can be composed entirely of static mixing elements or sections, it is preferred to alternate sections of static mixers with conventional conduit. The fluid mixture is first subjected to two or more static mixers to generate an equilibrium size droplet distribution and then passed through alternate sections of mixers and conventional non-mixing conduit. The section of pipe, or conduit, without the mixing elements allows reaction to take place with minimum separation of phases, which helps maximize the reaction rate at minimum overall energy consumption before the stream reaches another section of conduit containing at least one mixing element.

As previously mentioned, the resulting Group I/Group II polysulfide is insoluble in the treated hydrocarbon stream but is at least partially soluble in and substantially dissolves in the aqueous solution. The resulting mixture is passed to a liquid/liquid separation zone, such as a settling tank, wherein the mixture is allowed to separate into two phases wherein, depending on the difference in the density of the treated fluid as compared to the aqueous solution, the treated organic fluid forms either the top phase or the bottom phase. The treated hydrocarbon stream having a reduced elemental sulfur content can be drawn off as well as the immiscible aqueous solution phase having polysulfides contained therein. If the aqueous solution is not completely spent, all or a portion of it can be recycled to the process, as such, or with a quantity of make up aqueous solution added to maintain the volume and sulfur capacity of the solution within some preset limits.

In the process of the present invention it has been found that superior results are obtained in terms of level of elemental sulfur removed and physical condition of the organic fluid treated (e.g. clear or hazy and degree of caustic entrainment) when the treatment solution is the continuous phase of the mixture. The amount of aqueous solution required for use in the practice of the present invention will be that minimum amount needed to provide a system, under static mixing conditions, wherein the aqueous solution will preferably be maintained as the continuous phase.

Therefore, the process of the present invention can be run in an aqueous solution continuous phase mode at treat rates in the range of about 25 to 500%, preferably about 50 to 250%, relative to the hydrocarbon fluid being treated, and depending on just how spent the aqueous solution becomes. The more spent the aqueous solution (higher capacity factor) the higher the treat rate needed to insure that the caustic phase is the continuous phase.

FIG. 1 hereof represents one preferred embodiment for practicing the present invention. The elemental sulfur-containing hydrocarbon stream to be treated is conducted via line 10 through a preheat zone 15 where it is heated to a temperature of about 0° C. to about 60° C., preferably from about 30° C. to about 60° C. The preheated hydrocarbon stream is then passed via line 20 to static mixing zone 25. An effective amount of a caustic aqueous solution is introduced into the feed, preferably via line 50 from the source of caustic aqueous solution 55, before it enters static mixing zone 25. It is within the scope of this invention that the aqueous treatment solution be introduced directly into the static mixing zone 25 as the hydrocarbon stream is being passed there through. The statically mixed stream is conducted from static mixing zone 25 via line 30 to settling zone 55, which is preferably a settling tank, where the more viscous and heavier caustic treatment material, which will typically contain Group I/Group II metal polysulfides, settle to the bottom. The caustic treatment solution is then recycled to mixing zone 25 via line 50 to the front end of the static mixing zone 25. The treated hydrocarbon stream, that now contains substantially less elemental sulfur, is drawn off via line 40. The treated hydrocarbon stream will typically contain relatively low levels (70-110 wppm) of caustic. Although such a level is relatively low it is still unacceptable and the treated stream will preferably be passed to a zone wherein the caustic will be removed by conventional techniques, such as by passing the stream through a sand filter and a coalescer to reduce the caustic level to less than about 0.1 wppm. Make-up caustic treatment solution can be added to the system at any suitable location, but it is preferred to add it via line 70 into settler 55.

As previously mentioned, the caustic sulfide or polysulfide, are introduced into the sulfur containing fluid in the form of an aqueous solution that is immiscible with the hydrocarbon stream to be treated. The aqueous solution is formed either by combining the caustic and sulfide and or polysulfide in water. Note that in the tables below, the caustic concentration is sometimes referred to in degrees Baume. For a liquid heavier than water, degrees Baume is related to the specific gravity by the formula: specific gravity=145/(145−°Be).

The invention is further illustrated in the following non-limiting examples.

Example 1

This example shows that diesel fuel requires 50° C. using a multi-stage impeller type mixer to reduce the elemental sulfur (S°) to acceptable levels. A lab mixer was operated at a mixing energy of about 8 hp/kgal to simulate an existing commercial process. Table 1 below summarizes the operating conditions, elemental sulphur (S°) levels in the treated product and S° removal for this Example 1.

TABLE 1

| | Diesel 25°Be Caustic |
|---|---|
| $Na_2S$, wt % | 1.0 |
| Treat, vol % | 50 |
| Temperature, ° C. | 50 |
| S°, mg/l | |
| Start | 25 |
| @ 10 minutes | 2.8 |
| @ 20 minutes | 0.3 |
| S° Removal, % | 98.8 |

Example 2

This example shows that intensive mixing greatly increases the reaction rate by reducing mass transfer limitations. It also shows the added benefit of the addition of $Na_2S_4$ on reaction kinetics. Reaction times have been reduced from ~20 minutes to <1 minute. Table 2 below summarizes the effect of $Na_2S_4$ on the elemental sulphur (S°) levels in the treated product and S° removal for this Example 2.

TABLE 2

Conditions: 25°Be caustic, 1.5 wt. % $Na_2S$, 200% treat, 2° C., 65 hp/kgal, plus:

| $Na_2S_4$ wt % | None | 0.10 | 0.25 |
|---|---|---|---|
| S°, mg/l | | | |
| Feed | 103 | 107 | 106 |
| Product @ 3 minutes | — | 1.5 | 0 |
| Product @ 4 minutes | 99 | 0 | — |
| S° Removal, % | 4 | 100 | 100 |

Example 3

Figure 2:
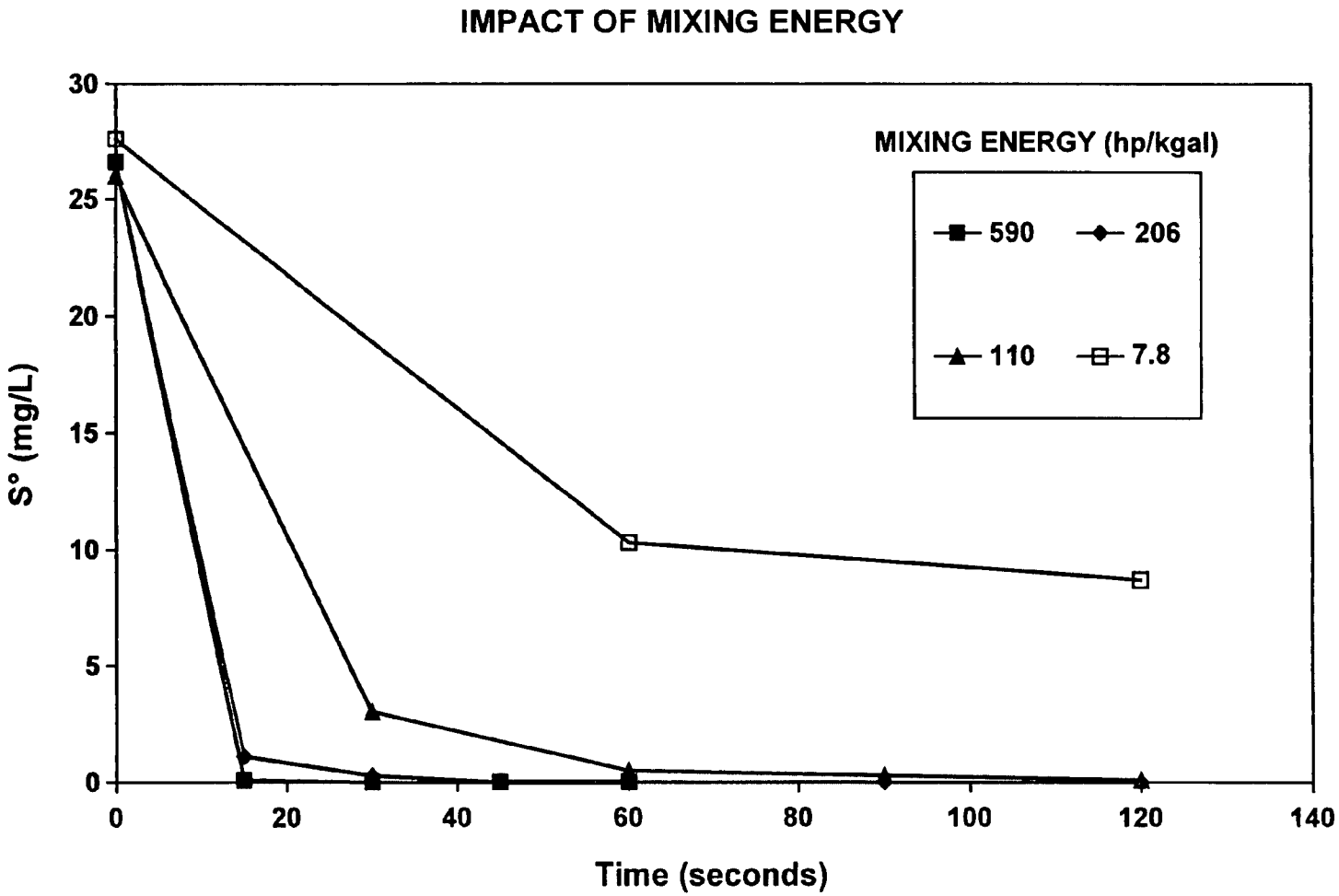
FIG. 2 hereof is a plot of the data of Table 3 hereof showing the positive impact of increased mixing energy on the removal of elemental sulfur from a hydrocarbon stream.

This example shows the positive impact of increased mixing energy, expressed as horsepower/1000 gals, on reaction rate. Experiments were conducted in the same lab mixer as used in Example 1 hereof and the results were plotted and shown in FIG. 2 hereof. The line at 7.8 hp/kgal simulates an existing commercial process using a multi-stage impeller (dynamic) type mixer. Table 3 below summarizes the operating conditions, elemental sulphur (S°) levels in the treated product and S° removal for this Example 3.

TABLE 3

Caustic: 18.7 wt % with 1.5 wt % $Na_2S$ and 0.25 wt % $Na_2S_4$, 100% treat

| mixing energy (hp/kgal) | 7.8 | 110 | 206 | 590 |
|---|---|---|---|---|
| Feed S°, mg/l | 27.6 | 26 | 26.6 | 26.6 |
| Product S°, mg/l @ secs | | | | |
| 15 | — | — | 1.1 | 0.1 |
| 30 | — | 3 | 0.3 | 0 |
| 45 | — | — | 0 | 0 |
| 60 | 10.3 | 0.5 | 0 | 0 |
| 90 | — | 0.3 | | |
| 120 | 8.7 | 0.1 | | |
| 180 | — | 0 | | |
| 300 | 6.5 | | | |

Example 4

This example shows that the process of the present invention can be successfully carried out using, in-line static mixers. A continuous test rig comprised of 4 static mixers with recycle was used for this test. The recycle allows varying the mixing energy while maintaining the residence time substantially constant under mixing conditions. Table 4 below summarizes the operating conditions, elemental sulphur (S°) levels in the treated product and S° removal for this Example 4.

TABLE 4

Conditions: 25°Be Caustic, 1.5 wt. % $Na_2S$ plus 0.25 wt. % $Na_2S_4$ at 18-20° C.

| | |
|---|---|
| Diesel, 1/min | 0.07 |
| Caustic, 1/min | 0.09 |
| treat, vol % | 130 |
| Mixers | 4 |
| recycle ratio | 12.5:1 |
| residence time, secs | 3.5 |
| (fresh feed in the 4 static Mixers) | |
| S°, mg/l | |
| Start | 22.2 |
| Mixer outlet | 0.5 |
| S° removal % | 98 |

Example 5

Figure 3:
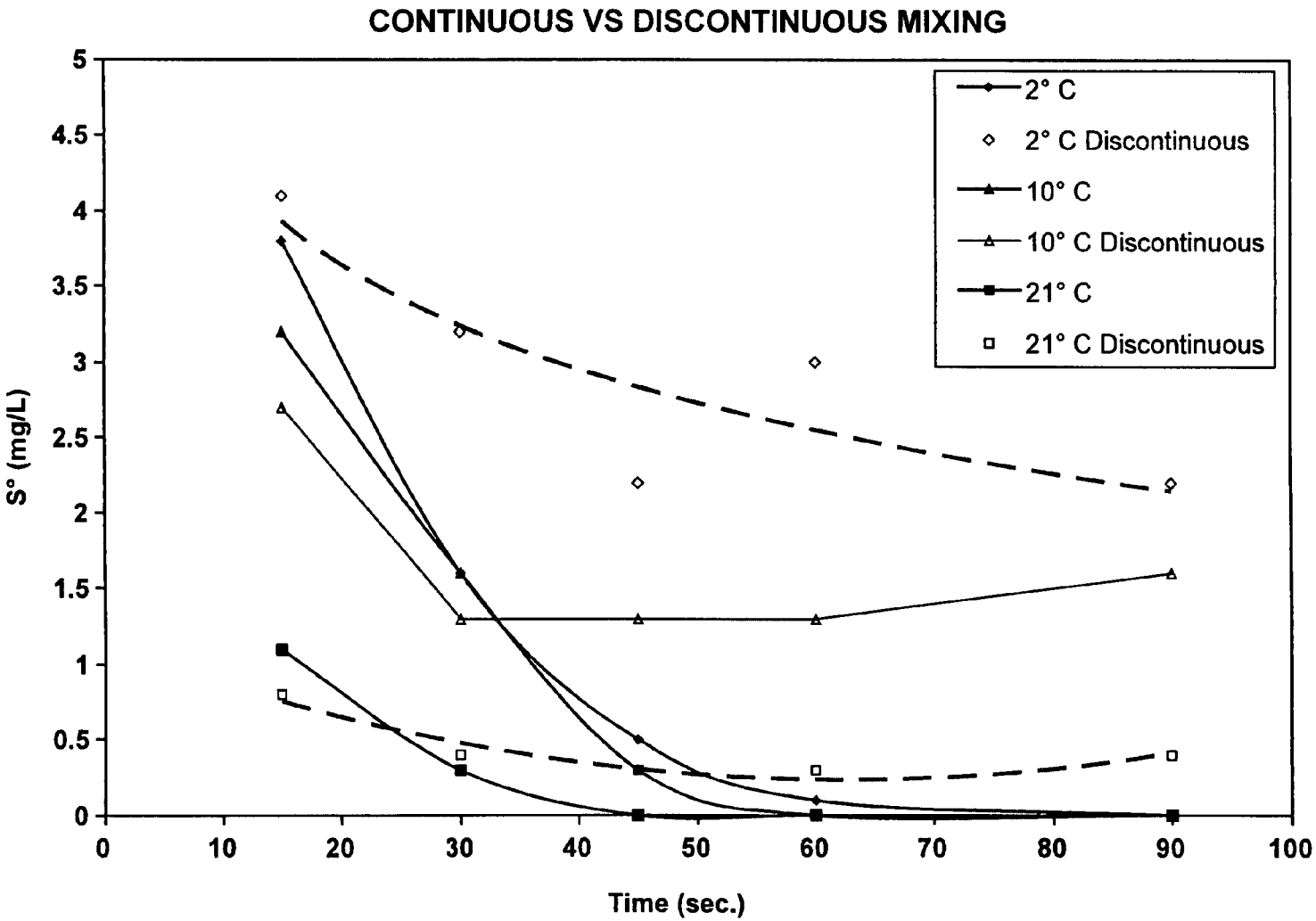
FIG. 3 hereof is a plot of the data of Table 5 hereof showing that when the mixing is discontinued the elemental sulfur removal reaction continues for an amount of time.

This example shows that reaction continues at a reasonable rate for several seconds after mixing is discontinued. Experiments were conducted in the same lab mixer as used in Example 1 hereof using 25 Be caustic, 1.5 wt. % $Na_2S$, 0.25 wt. % $Na_2S_4$, 100% treat rate and 206 hp/kgal mixing energy and at various temperatures ranging from 2 to 21° C. Mixing was discontinued after 20 seconds. The results, which are presented in FIG. 3 hereof, indicate that the reaction continues after mixing is discontinued, but at a slower rate. Feed and reaction solution are intimately mixed in a static mixer to create a dispersion, which then is allowed to partially settle in an empty pipe section before being re-mixed in the next static mixer. The overall mixing system thus consists of alternate mixer and empty pipe sections. Table 5 below summarizes the operating conditions, elemental sulphur (S°) levels in the treated product and S° removal for this Example 5.

TABLE 5

Caustic: 18.7 wt % with 1.5 wt % $Na_2S$ plus 0.25 wt % $Na_2S_4$, 100% treat, Mixing Energy = 206 hp/kgal

| | Discont. | Cont. | Discont. | Cont. | Discont. | Cont. |
|---|---|---|---|---|---|---|
| Feed S°, mg/l | 26.6 | 25.7 | 24.4 | 24.4 | 26.6 | 26.6 |
| Temp. ° C. | 2 | 2 | 10 | 10 | 21 | 21 |
| Product S°, mg/l @ secs. | | | | | | |
| 15 | 4.1 | 3.8 | 2.7 | 3.2 | 0.8 | 1.1 |
| 30 | 3.2 | 1.6 | 1.3 | 1.6 | 0.4 | 0.3 |
| 45 | 2.2 | 0.5 | 1.3 | 0.3 | 0.3 | 0 |
| 60 | 3 | 0.1 | 1.3 | 0 | 0.3 | 0 |
| 90 | 2.2 | 0 | 1.6 | 0 | 0.4 | 0 |

The invention claimed is:

1. A process for the removal of elemental sulfur from a hydrocarbon stream containing same, which process comprises:

a) treating said hydrocarbon stream with an effective amount of an aqueous solution comprised of combining water, a caustic, at least one monosulfide compound selected from the group consisting of Group I and Group II metal sulfides, and sodium tetrasulfide, $Na_2S_4$, wherein the combined amount of monosulfides and polysulfides in the aqueous solution is from about 0.1 to 5 wt % and the amount of sodium tetrasulfide, $Na_2S_4$, in the aqueous solution is at least about 0.1 wt %;

b) conducting said treated hydrocarbon stream through one or more sections of pipe whose inner surface contains one or more mixing elements wherein said treated hydrocarbon stream is subjected to static mixing conditions for an effective amount of time thereby resulting in a two phase system wherein the aqueous solution is one phase and the hydrocarbon stream is another phase and wherein the elemental sulfur of the hydrocarbon stream is converted to polysulfides that are substantially insoluble in the hydrocarbon stream but substantially soluble in the aqueous phase and wherein at least a portion of the polysulfides formed from elemental sulfur of the hydrocarbon stream dissolves in the aqueous phase;

c) conducting the two phase system of b) to a liquid/liquid separation zone wherein the two phase system is separated into a hydrocarbon phase and an aqueous phase containing dissolved polysulfides formed from the elemental sulfur of the hydrocarbon stream;

d) collecting the resulting hydrocarbon stream from said liquid/liquid separation zone, which hydrocarbon stream is substantially reduced in elemental sulfur; and e) collecting the aqueous phase containing polysulfides formed from elemental sulfur of the hydrocarbon stream.

2. The process of claim 1 wherein the hydrocarbon stream is a petroleum stream.

3. The process of claim 2 wherein the petroleum stream is selected from the group consisting of naphtha boiling range streams and distillate boiling range streams.

4. The process of claim 1 wherein the hydrocarbon stream to be treated contains from about 1 to about 1,000 mg of elemental sulfur per liter.

5. The process of claim 4 wherein the hydrocarbon stream to be treated contains from about 1 to about 60 mg of elemental sulfur per liter.

6. The process of claim 1 wherein the caustic is selected from the group consisting of sodium hydroxide and potassium hydroxide.

7. The process of claim 1 wherein the static mixing conditions are created by passing said hydrocarbon stream and treatment solution through an effective length of pipe having internal mixing elements.

8. The process of claim 7 wherein the effective length of pipe having internal mixing elements is continuous.

9. The process of claim 7 wherein the effective length of pipe having internal mixing elements is non-continuous such that sections of pipe having internal mixing elements have sections of pipe not containing internal mixing elements at least one end thereof.

10. The process of claim 1 wherein the monosultide is $Na_2S$.

11. The process of claim 1 wherein the amount of sodium tetrasulfide, $Na_2S_4$, in the aqueous solution is from about 0.1 to 0.25 wt %.

* * * * *

UNITED STATES PATENT AND TRADEMARK OFFICE

CERTIFICATE OF CORRECTION

PATENT NO. : 8,658,028 B2
APPLICATION NO. : 12/448684
DATED : February 25, 2014
INVENTOR(S) : Uppal et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 833 days.

Signed and Sealed this
Twenty-ninth Day of September, 2015

Michelle K. Lee

Michelle K. Lee
*Director of the United States Patent and Trademark Office*